United States Patent [19]

Planchamp

[11] Patent Number: 4,595,559

[45] Date of Patent: Jun. 17, 1986

[54] PROCESS FOR THE PRODUCTION OF COMPOSITE ALLOYS BASED ON ALUMINUM AND BORON AND PRODUCT THEREOF

[75] Inventor: Claude Planchamp, Chantilly, France

[73] Assignee: Fonderies Montupet, Nanterre, France

[21] Appl. No.: 619,596

[22] PCT Filed: Oct. 4, 1983

[86] PCT No.: PCT/FR83/00199

§ 371 Date: Jun. 4, 1984

§ 102(e) Date: Jun. 4, 1984

[87] PCT Pub. No.: WO84/01390

PCT Pub. Date: Apr. 12, 1984

[30] Foreign Application Priority Data

Oct. 5, 1982 [FR] France ..... 82 17108

[51] Int. Cl.[4] ..... C22C 1/10; C22C 21/00

[52] U.S. Cl. ..... 420/528; 420/590; 75/68 R

[58] Field of Search ..... 148/437; 420/590, 528; 75/254, 68 R

[56] References Cited

U.S. PATENT DOCUMENTS

| | | | |
|---|---|---|---|
| 1,921,998 | 8/1933 | Bonsack | 75/58 |
| 3,037,857 | 6/1962 | Conant | 75/138 |
| 3,464,816 | 9/1969 | Biddulph | 75/135 |
| 3,468,653 | 9/1969 | Jerald | 420/590 |
| 3,503,738 | 3/1970 | Cooper | 75/135 |
| 3,864,154 | 2/1975 | Gazza et al. | 75/254 |
| 4,248,630 | 2/1981 | Balmuth | 75/135 |
| 4,364,770 | 12/1982 | Douchy et al. | 75/53 |
| 4,417,923 | 11/1983 | Beranck | 75/257 |

FOREIGN PATENT DOCUMENTS

| | | |
|---|---|---|
| 1265089 | 6/1961 | France . |
| 1268812 | 3/1972 | United Kingdom . |

*Primary Examiner*—Christopher W. Brody

*Attorney, Agent, or Firm*—Dennison, Meserole, Pollack & Scheiner

[57] ABSTRACT

The present invention relates to a process for the production of composite alloys based on aluminum, which may or may not be alloyed, and containing up to 30% by weight of boron.

The process is characterized in that the boron is introduced into the liquid aluminum in the form of aluminum boride having the formula $AlB_2$ or $AlB_{12}$.

It finds application in the production of composite alloys which are resistant to abrasion or which are intended to serve as neutron barriers in air or an aqueous medium.

6 Claims, No Drawings

PROCESS FOR THE PRODUCTION OF COMPOSITE ALLOYS BASED ON ALUMINUM AND BORON AND PRODUCT THEREOF

The present invention relates to a process for the production of composite alloys based on aluminum, which may or may not be alloyed, and boron, and application thereof.

It is general practice among those involved in the melting and casing of aluminum to add boron to the molten metal to cause the production of $TiB_2$ crystals which play an important part in regard to seeding of the Al crystals upon solidification and which constitute an excellent way of refining the grain size upon casting.

It is also known for aluminum alloys to be doped with that element in order to precipitate titanium in the form of $TiB_2$ crystals, thereby to enhance their electrical conductivity.

In such uses, boron is added to the aluminum at relatively low levels of concentration, which are in the range of a few hundreds of ppm, and, if the introduction of such small amounts gave rise to problems at a certain period of time, that has been overcome since then by virtue of using mother alloys such as AT5B. The situation is not the same when the levels of concentration of boron to be attained are of the order of several percent.

It is known in fact that the solubility of boron in aluminum is very low and is on the order of 300 ppm at the melting point of aluminum, so that, if the attempt is made to produce boron-charged alloys using the conventional process of melting and casting in the form of ingots, difficulties are encountered due to incomplete dissolution, substantial losses of boron, and a severe degree of segregation of the boron. The effect of that is to result in composite alloys which overall do not comply with the compositions expected and which are of a heterogeneous structure.

It is for that reason that research workers and companies have sought to remedy such disadvantages, and have proposed various solutions of greater or lesser attractiveness.

In French Pat. No. 1,265,089 concerning an aluminum alloy containing from 2.5 to 10% of boron, the inventor recalls that hitherto it had been necessary to prepare such alloys either by adding boron to molten aluminum or by reducing a boron compound such as borax, with the molten aluminum. However, in the former case, the alloys contained only a very small amount of boron in alloy form and required excessively long periods of dissolution, while in the latter case the use of borax resulted in occlusions of undesirable nature of oxygen and other impurities. The inventor then proposes incorporating the boron by the reduction of an alkali metal fluoborate in contact with the molten aluminum. However, it should be noted that such a process, besides the burdensome installation that it requires for the process to be carried into effect, results in poor yields, a part of the boron being lost both in the form of $KBF_4$ and $BF_3$, which is a highly toxic compound by virtue of the emissions of HF to which it gives rise in a humid atmosphere.

Moreover, the alloy produced in that way serves as a mother alloy for the refining of aluminum, that is to say, a very small amount thereof is introduced into the bath to be refined and consequently the problem of its homogeneity is not a matter of substantial importance, as what counts above all is a mean concentration of boron in the bath.

The problem becomes more severe when alloys with a high boron content are intended for example for the production of components which must have either a high level of resistance to abrasion or a suitable capacity for absorbing neutron radiation, as in that case the boron must be regularly distributed so that it is capable of performing its function in a uniform fashion throughout the component.

Thus, the solutions which have been proposed hitherto move away from the process of producing mother alloys and are oriented rather towards powder metallurgy. Thus, French patent No. 2,231,764 claims a process for the production of metal boron-containing products which are intended for the nuclear industry, characterized in that the metal material and the boron-base substance are in the form of powders, said powders being mixed, pressed and sintered.

That is obviously one way of achieving the desired condition of homogeneity, but it requires the use of powders, the production of which constitutes an additional step in comparison with the conventional process of melting and casting, and it does not always permit the components to be produced in the desired shapes.

Another solution comprises making composite alloys of aluminum and boron carbide ($B_4C$), but serious difficulties are encountered in regard to casting such alloys, without mentioning the indifferent mechanical characteristics and the nonmachineability of the resulting products. In aqueous media, such alloys must often by protected by aluminum plating or cladding.

It is for that reason that the applicants, considering that the solutions proposed were not satisfactory, sought and developed a process for the production of composite alloys based on aluminum which may or may not be alloyed, and containing up to 30% of boron, which are of a homogeneous structure and which have suitable mechanical characteristics, in which process the boron losses are virtually nil and which does not require complex and costly equipment for carrying the process into effect.

That process is characterized in that the boron is introduced into the liquid aluminum in the state of aluminum boride. Therefore, this procedure has recourse to the most highly conventional method of producing alloys in metallurgy; however, unlike the prior art processes, the boron is no longer in an elementary state or in the form of oxides or salts such as borax and fluoborates but is in the form of aluminum boride.

The above-mentioned boride, which is either the diboride $AlB_2$ or dodecaboride $AlB_{12}$ or a mixture of the two thereof, is a clearly defined compound which has a high degree of stability in air and which is substantially nonvolatile and which enjoys the advantage of not producing noxious emanations. It may be prepared in different ways known to the man skilled in the art and put into the form of particles with a mean grain size of between 5 and 30 $\mu$m, being encased with aluminum to facilitate the wetting thereof and introduction thereof into the liquid aluminum.

It is introduced into an aluminum bath or any of the alloys thereof which form part of the series 2000 to 8000, which has preferably been previously treated to a refining treatment, for example, by means of AT5B. The bath is protected at its surface by a deoxidizing flux which is used in conventional fashion in aluminum metallurgy and is maintained in an agitated condition throughout the period over which the boride is introduced.

The speed at which the boride is introduced is so controlled as to maintain the bath of aluminum or alloy above its solidification temperature.

It may be useful for those operations to be carried out in an installation in which there is maintained an atmosphere of inert gas such as nitrogen U for example so as to prevent any contamination from air or moisture.

When the amount of boron required for achieving the desired level of concentration in the composite alloy has been added, the bath is then subjected to degassing in a nitrogen atmosphere or under vacuum, and the alloy is rapidly cast either in a mold or in order directly to produce a component of suitable shape or in an ingot mold to give a product which is then subjected to at least one of the various transformation operations such as rolling, forging, extrusion, drawing, etc.

By way of example, the process according to the invention was used to prepare a composite alloy of type A-S10$B_3$ which was then formed by casting into casks intended for transporting radioactive materials. Micrographic examination of the alloy revealed regular distribution of the boride in the aluminum alloy matrix. From comparative metallurgical tests with normal A-S10 it is deduced that the presence of the boron does not affect the qualities of the matrix which retains a good part of its properties, whether physical: density, thermal conductivity, coefficient of expansion and solidification range; or mechanical: strength and elongation, although the latter property is slightly reduced; or technological: good suitability for forging, rolling, drawing, casting, welding, machineability and fluid-tightness.

Moreover, hydrolysis tests show a high level of stability of the alloy in demineralized water at 40° C., and the absence of any trace of corrosion.

The process according to the invention finds application in the production of composite alloys which are expected to have a high level of resistance to abrasion or to friction.

The process also finds application by virtue of the presence of boron, which is a neutron-trapping element, and its other properties, in the production of neutron barriers which are used in the field of nuclear energy in the form of casks for the storage and transportation of nuclear waste, either in air or in an aqueous medium.

This composite alloy thus advantageously replaces all manufactures which are mechanically welded or cast with a boron-containing material insert both from the point of view of ease of use and cost price, particularly when compared with boron-containing copper plates or boron-containing stainless steel cases.

I claim:

1. A process for the production of a metallic matrix composite alloy having a high level of resistance to abrasion and the property of trapping neutrons, comprising the steps of:

(a) preparing aluminium boride in the form of particles with a mean grain size of between 5 and 30 $\mu$m encased with aluminium;

(b) introducing said encased aluminium boride into a previously refined aluminium or aluminium alloy bath protected at its surface by a deoxidizing flux, the quantity of boron in said bath being at most 30% by weight;

(c) agitating said bath throughout the period of introduction of said encased aluminium boride;

(d) controlling the introduction speed of said encased aluminium boride so as to maintain the bath above its solidification temperature;

(e) subjecting the bath to degassing in a nitrogen atmosphere or under vacuum subsequent to the introduction of said encased aluminium boride; and (f) rapidly casting said degassed bath.

2. The process according to claim 1, wherein the aluminium boride is selected from the group consisting of the diboride $AlB_2$, the dodecaboride $AlB_{12}$ and mixtures thereof.

3. The process according to claim 1, wherein said introduction is carried out under an atmosphere of inert gas.

4. An abrasion resistant composite alloy produced in accordance with claim 1, comprising aluminium boride regularly distributed in an aluminium alloy matrix, said composite alloy containing an amount of aluminium boride corresponding to an amount of boron of up to 30% by weight.

5. A neutron barrier comprising a composite alloy in accordance with claim 4.

6. A cask for the storage and transportation of nuclear waste in accordance with claim 4.

* * * * *